United States Patent [19]

Barthelmes et al.

[11] Patent Number: 5,037,342

[45] Date of Patent: Aug. 6, 1991

[54] METHOD OF MAKING AN ELECTRIC LAMP, AND MORE PARTICULARLY A LAMP VESSEL IN WHICH ELECTRODES ARE RETAINED IN THE LAMP BY A PINCH OR PRESS SEAL

[75] Inventors: Clemens Barthelmes; Axel Bunk, both of Berlin, Fed. Rep. of Germany

[73] Assignee: Patent Treuhand Gesellschaft fur Elektrische Gluhlampen m.b.h., Munich, Fed. Rep. of Germany

[21] Appl. No.: 434,084

[22] Filed: Nov. 9, 1989

[30] Foreign Application Priority Data

Nov. 15, 1988 [DE] Fed. Rep. of Germany ..... 3838696
Nov. 15, 1988 [DE] Fed. Rep. of Germany ..... 3838697

[51] Int. Cl.[5] ..... H01J 9/40; H01J 9/24

[52] U.S. Cl. ..... 445/22; 445/22; 445/27; 445/39; 445/43; 65/59.26; 65/105; 65/109

[58] Field of Search ..... 445/27, 38, 39, 22, 445/26, 43; 65/32.2, 42, 59.26, 105, 109

[56] References Cited

U.S. PATENT DOCUMENTS

| | | | |
|---|---|---|---|
| 3,073,137 | 1/1963 | Fraser | 445/43 |
| 3,685,880 | 8/1972 | Sobieski | 445/43 |
| 3,798,491 | 3/1974 | Malm | 445/27 X |
| 3,810,684 | 5/1974 | Robinson . | |
| 4,178,050 | 12/1979 | Kiesel et al. | 445/27 |
| 4,509,928 | 4/1985 | Morris et al. | 445/39 |
| 4,658,177 | 4/1987 | Gosslar et al. | 313/623 X |
| 4,693,692 | 9/1987 | Hamai | 445/39 X |
| 4,717,852 | 1/1988 | Dobrusskin et al. | 313/634 X |
| 4,739,220 | 4/1988 | Dobrusskin | 445/26 |
| 4,851,735 | 7/1989 | Gosslar et al. | 313/621 X |

*Primary Examiner*—Kenneth J. Ramsey
*Attorney, Agent, or Firm*—Frishauf, Holtz, Goodman & Woodward

[57] ABSTRACT

To make a lamp of quartz or hard glass which has a bulb (10, 22) which does not have an exhaust tip, for example a metal halide high-pressure discharge lamp or a halogen incandescent lamp, the glass bulb is formed by blow-molding the bulb to the desired shape, then retaining an electrode system having electrodes (14, 14*a*) to be placed in the bulb, current supply leads (12, 24) extending externally of the bulb, and sealing foils (13, 23) connecting the current supply leads to the electrodes in a holder die (11, 25), introducing the electrodes by moving the holder die towards the bulb, flushing the bulb by introducing and selectively removing flushing gas through an open end of the tube, introducing a measured quantity of a fill substance, such as mercury, an iodide or the like, into the bulb through the open end thereof, and then heating the bulb in the region of the position of the sealing foils and pinch-sealing the bulb. Excess glass is then cut off and the bulb can be supplied with a base. To introduce the fill gas and fill substances, the holder die can be formed with a through-opening through which gas exchange can take place and fill substances, for example in form of pellets or pills introduced. The pinch-sealing can be carried out in two steps, one step pinch-sealing the electrode system but leaving capillary openings (62) adjacent the side walls of the tube to permit gas exchange. The capillaries can then be melted shut by a pointed flame.

33 Claims, 17 Drawing Sheets

FIG. 7a
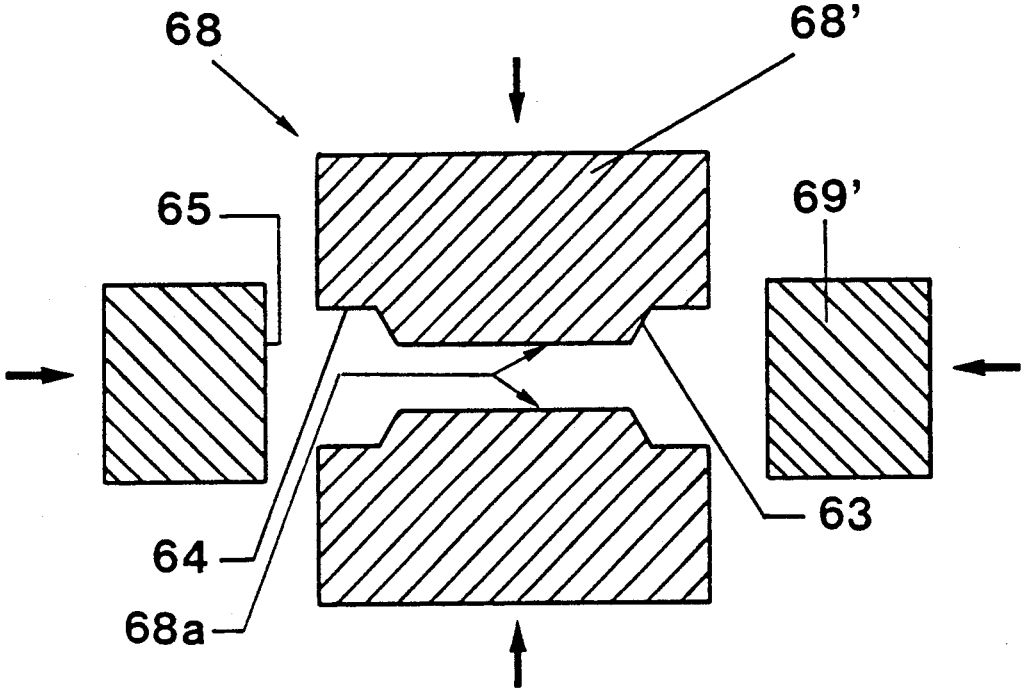
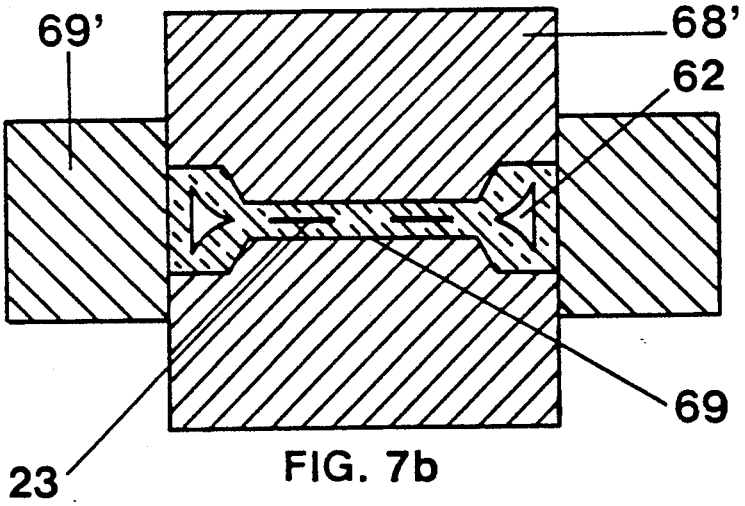
FIG. 7b
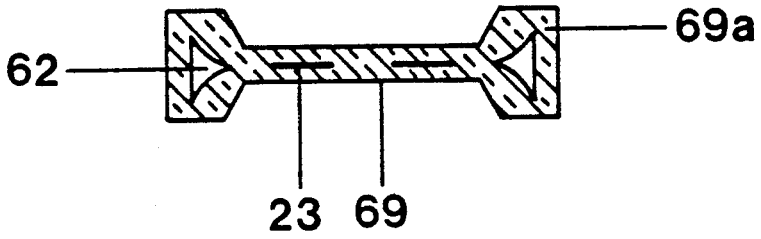
FIG. 7c

METHOD OF MAKING AN ELECTRIC LAMP, AND MORE PARTICULARLY A LAMP VESSEL IN WHICH ELECTRODES ARE RETAINED IN THE LAMP BY A PINCH OR PRESS SEAL

Reference to related patents, the disclosure of which is hereby incorporated by reference, assigned to the assignee of the present application:

U.S. Pat. No. 4,178,050
U.S. Pat. No. 4,658,177
U.S. Pat. No. 4,717,852
U.S. Pat. No. 4,851,735

The present invention relates to a method to make an electric lamp, and more particularly to make a lamp in which an electrode system is retained in the lamp bulb by a single pinch or press seal. The method is particularly applicable, although not restricted to discharge lamps or to halogen incandescent lamps.

BACKGROUND

When making electric lamps with a single pinch seal, and particularly electric lamp bulbs utilizing quartz glass or hard glass in which an electrode system is retained, it has been customary to reduce one end of an open glass tube in diameter, and seal a pump tube or exhaust tube thereto. The electrode system is introduced from the other end. The bulb is flushed with a flushing gas, such as argon while a pinch or press machine seals the electrode system at the end remote from the exhaust tube. The raw lamp bulb, including the exhaust tube, is then placed on a special machine stand. Fill substances, for example a halogen pellet such as an iodide pellet, mercury and the like are introduced through the pump tube. The fill gas may already be retained within the lamp bulb, for example if argon has been used as a flushing gas it may, at the same time, form the fill gas. The small tube at the end remote from the pinch or press seal, where the base will also be formed, is then tipped off, to melt the bulb shut.

The finished bulb will leave a small melt tip, which formed the pumping tube before it was tipped off. This pumping tube tip at the lamp vessel is undesirable; it has several serious disadvantages.

If the lamp is operated in a base-down position, and the lamp bulb is used with an electrode system which forms a discharge arc, the tip point is highly heated by the discharge between the electrodes. Any non-uniformities in the wall thickness may lead to deformation of the lamp vessel due to the high temperature and the high operating pressure, which may rise to about 50 bar. In extreme situations, the melting point or junction of the prior tip tube to the lamp vessel may become leaky or, if the lamp wall is thin at one place, the lamp vessel may burst. If the lamp is operated base-up, the cold spot temperature of a discharge lamp, and thus the color index of the light emitted by the lamp, will be determined, at least in part, by the distribution of the material at the region of the pumping tube tip, and the geometry thereof. Thus, the lamp may not meet specifications. Differential distribution of lamp bulb material in the vicinity of the exhaust tip also leads to optical distortion of the light. This is particularly undesirable if the lamp is to cooperate with reflectors requiring a predetermined light distribution therefrom.

THE INVENTION

It is an object to provide a method to make a lamp with a lamp bulb which does not have an exhaust tip, and in which the distribution of the material of the lamp bulb or discharge vessel is essentially uniform so that the above referred-to disadvantages are effectively eliminated.

Briefly, a raw glass tube is formed by closing off a tube of glass, typically quartz glass, in a forming machine, preferably by forming rollers. The glass tube, closed at one end, is then blow-molded, so that a bulb having the shape of the light emitting vessel is formed in a mold. An electrode system, having typically inner electrodes, current supply leads and interposed sealing foils is held in a holder die, and introduced by the holder die through the open end into the lamp vessel in predetermined position to place the electrodes in predetermined locations within the bulb. The bulb is flushed, and flushing gas is introduced and removed through the open end of the bulb. Measured or dosed quantities of fill substances, such as mercury, a halide compound or the like, are then introduced through the open end of the bulb and, then, the open end of the bulb is heated and the electrode system is pinch-sealed in the region of the sealing foils of the electrode system. Excess glass tubing beyond the pinch seal is then cut off.

In accordance with a feature of the invention, the holder die for the electrode system has a through-bore through which, selectively, a gas tube can be inserted for flushing and introducing of fill gas or a funnel or the like through which solid or liquid fill substances can be introduced into the bulb, for example mercury and/or other fill substances, for instance a halide compound. This method is especially successful and appropriate for the inner or single envelope of a lamp and/or for lamps which require solid or liquid fill substances. It ensures very high purity of the fill substances.

The same process can be used to place the finished lamp into an outer envelope, if such is desired. Another possibility, less expensive and faster and especially appropriate for the outer envelope where only a gaseous fill has to be introduced and the need for high purity is less urgent, is to pinch-seal the electrode system into the lamp in such a manner that capillary openings are left adjacent the sealing region for the electrode system, typically molybdenum foils. The gas fill can then be introduced through the capillary openings, or the space within the bulb evacuated therethrough; when the proper gas—or vacuum—within the lamp envelope is obtained, the capillary openings are quickly heated and will melt shut, thus sealing the entire lamp structure air and gas tightly with respect to ambient space. Preferably, the pinch or press seal is flat, having two long and two short sides, and the capillary openings are located adjacent the short sides of the pinch seal which positions the electrodes.

The method has the advantage that the light emitting vessel, which may retain discharge electrodes, will have a precisely determinable volume and furthermore an essentially homogeneous wall thickness distribution throughout, since no exhaust tube was ever melt-connected thereto. Deformation in operation, such as bulging or formation of a bubble, pin holes, or even explosion of the lamp bulb are effectively prevented. Due to the uniform wall thickness of the lamp vessel, the temperature distribution in the lamp likewise will be uniform and the cold spot temperature will be defined and readily reproducible in the lamps. Thus, the light being emitted will have a reproducible spectral composition and color index; the lamp data can be maintained within tight tolerances.

An additional advantage of the system is that optical distortions due to non-uniformities of the material of the lamp vessel will no longer occur, so that the lamp is eminently suitable for use in combination with high-quality reflectors. Additionally, and as a further advantage, by suitably shaping the mold in which the lamp is being blow-molded, the lamp vessel can be made to have a lens-like cap or end portion. Such lensatic bulbs can be used to obtain special optical effects directly, or in combination with further optical systems.

The method in accordance with the present invention has the additional advantage of being eminently suitable for automated production. Besides the qualitative advantages, a larger quantity of lamps can be made cheaper since the step of applying an exhaust tube to the bulb of the lamp has been eliminated, and a more reliable method for making the pinch seal is given because the pinch seal can be preshaped.

The process is suitable to make single pinch-sealed halogen discharge lamps, halogen incandescent lamps, or any other types of lamp, although especially applicable to lamps operating with high internal pressure and meeting tight performance characteristics.

Drawings, illustrating, schematically, the method steps to form a metal halide high-pressure discharge lamp with an external surrounding bulb.

FIGS. 1*a* to 1*d* show schematically the steps to make quartz glass tubes closed at one end;

FIGS. 1*e* and 1*f* show an alternative way to make the closed end;

FIGS. 2*a* and 2*b* show the sequential steps to make the light emitting vessel;

FIG. 2*c* is a top view of the light emitting vessel;

FIGS. 2*d* to 2*f* show an alternative way of making the light emitting vessel;

FIGS. 3*a* through 3*d* illustrate the sequential steps of flushing, filling, and pinch sealing a raw bulb;

FIG. 4 is a schematic side view in section of a metal halide discharge lamp made in accordance with the process of the invention;

FIG. 4*a* illustrates a lamp in which the electrodes include a filament, the illustration being rotated 90° with respect to the showing of FIG. 4;

FIGS. 5*a*, 5*b* and 5*c* illustrate sequential steps to insert the lamp of FIG. 4 or 4*a* into an outer bulb;

FIGS. 6*a* and 6*b* illustrate introduction of the lamp of FIG. 4 or 4*a* into an outer bulb and into a pinch or press sealing machine in accordance with another embodiment of the invention;

FIGS. 7*a* and 7*b* illustrate sequential steps in the operation of the pinch sealing jaws;

FIG. 7*c* is a cross section of the pinch seal of the electrode system;

Figure 1A:
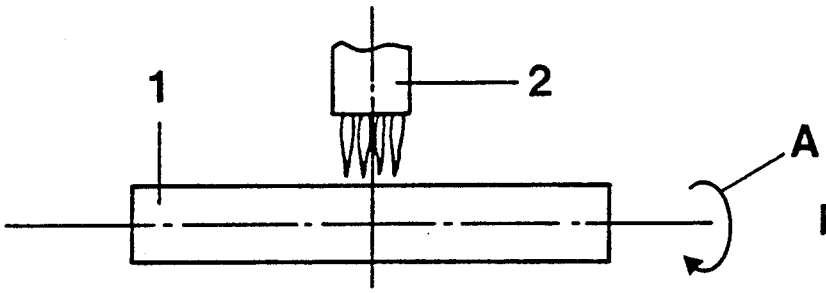
Figure 1B:
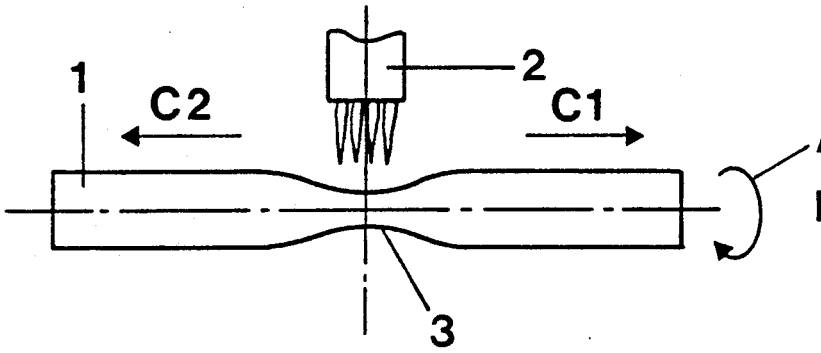
Figure 1C:
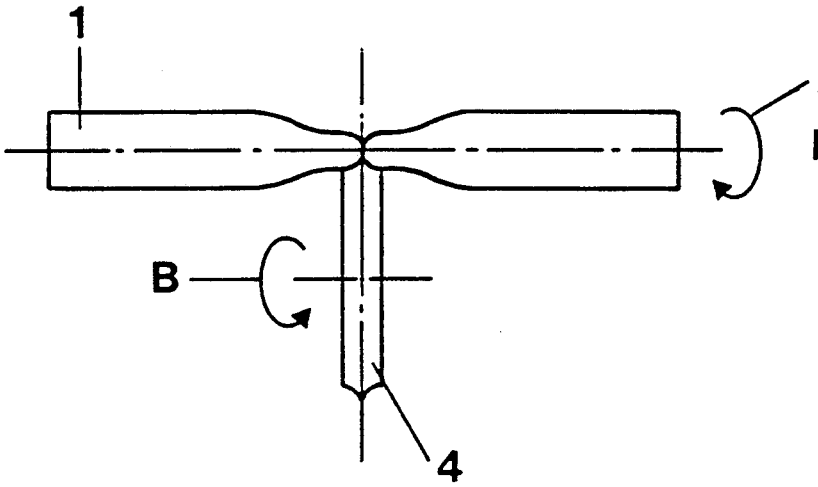
Figure 1D:
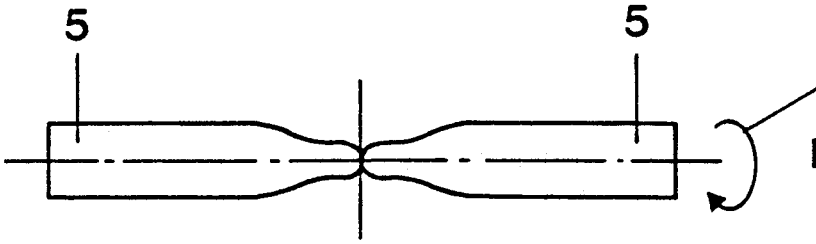

In the figures, sequential steps are shown and, to the extent feasible, when the steps are carried out with structures in a given alignment, the alignment lines for the respective steps will be illustrated in the drawings throughout the figures to show the interrelationship of the steps and the alignment of the articles or operating elements carrying them out.

DETAILED DESCRIPTION

Referring first to the sequence of FIGS. 1*a* to 1*d*, which illustrate the preparation of a single-ended closed quartz tube to form a light emitting vessel of uniform wall thickness.

A quartz tube 1 placed in a holder (not shown), is heated at a predetermined location, for example in the center thereof, by a flame 2, while the tube 1 is being rotated, as schematically shown by arrow A (FIG. 1*a*). The tube ends are then drawn outwardly, as shown by arrows C1, C2, see FIG. 1*b*, so that the heated softened part of the glass will be thinned. The still soft glass is then closed off and pinched by a roller 4, rotating as schematically shown by arrow B and having the cross-sectional shape illustrated in FIG. 1*c*, in other words, to form a cup or cap-like bulb end and closing off the tube 1 in two portions.

Figure 1E:
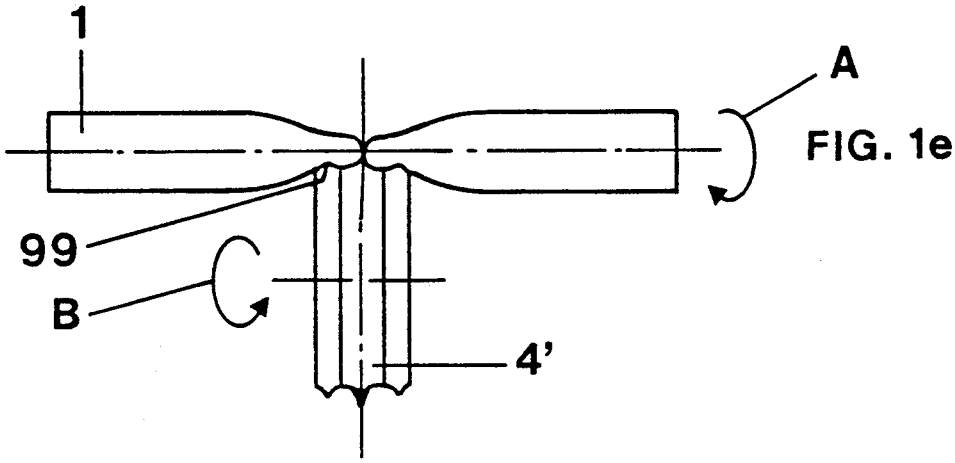
Figure 1F:
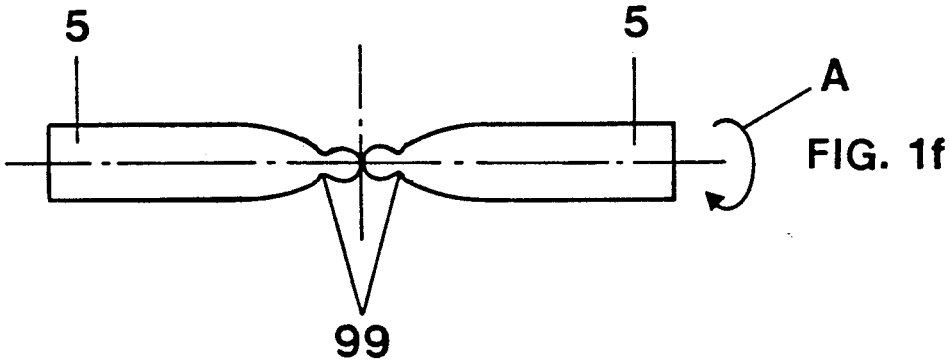

The roller 4' may have a forked surface (FIG. 1*e*) to form additionally a bottle-necked portion 99 of rotational symmetry near the bulb end. This, also, preforms the region of the subsequent light emitting vessel. Two quartz elements for subsequent manufacture of two lamps are thereby obtained in essentially one production step. These two, single closed tube elements 5 are seen FIG. 1*d*, resp. 1*f*.

They are separated after removal from the rotating holder.

Figure 2A:
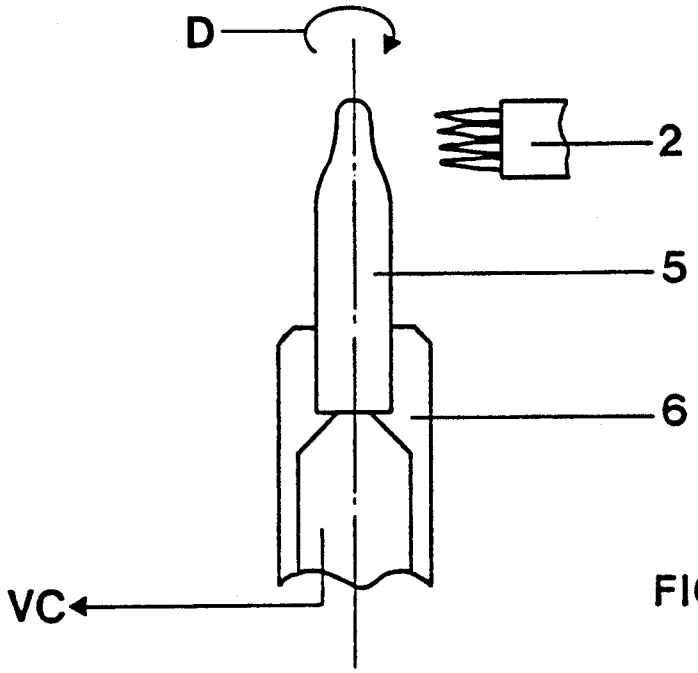
Figure 2B:
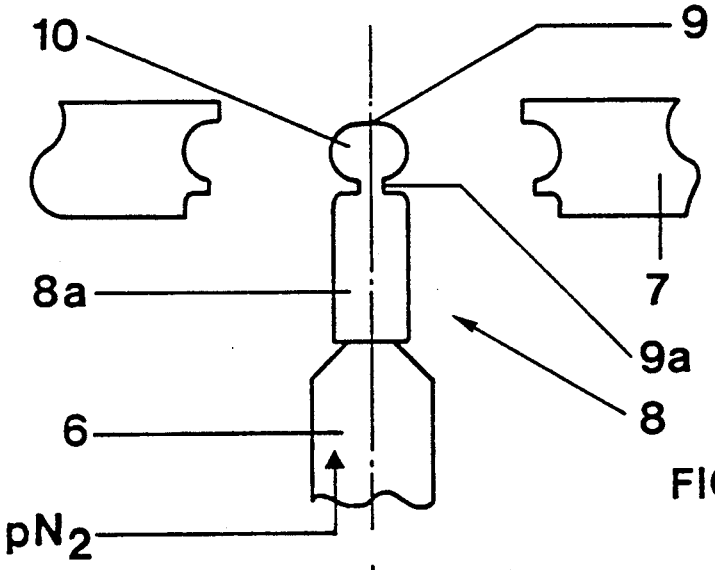
Figure 2C:
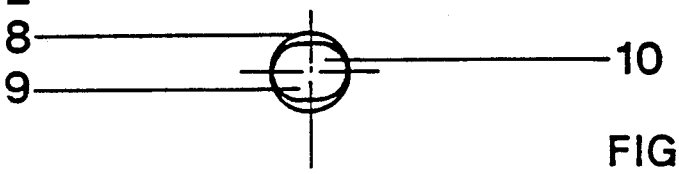

As illustrated in FIG. 2*a*, one of these elements 5 is then placed in a rotary holder 6, rotating as schematically shown by arrow D. This rotary holder 6 can be coupled, selectively, to a vacuum, as schematically shown by the arrow VC, or to a source of gas, at higher pressure, as shown by the arrow $pN_2$ in FIG. 2*b*. The closed end of the element 5 is heated by flame 2 (FIG. 2*a*). For preforming of the element 5, a vacuum VC can be applied. When the quartz glass is soft, the flame 2 is stopped and two oppositely located forming jaws or mold jaws 7 are moved to surround the heated end of the element 5 while, simultaneously, pressurized nitrogen, as schematically shown by arrow $pN_2$, is supplied to the interior of the element 5. A suitable pressure is about 2 bar. This effectively blow-molding of the tube element 5 results in a raw tube 8 which will form a light emitting vessel 10 having a dome-shaped end portion 9, a bottle-necked portion 9*a* and a long collar 8*a*. The region of the subsequent lamp vessel 10, when it is finished, thus will have the very precise shape of the blow-molding mold form, which for example is ellipsoid, see FIG. 2*c*, which shows the light emitting vessel 10 and the circumference of the raw tube 8, in top view.

Figure 2D:
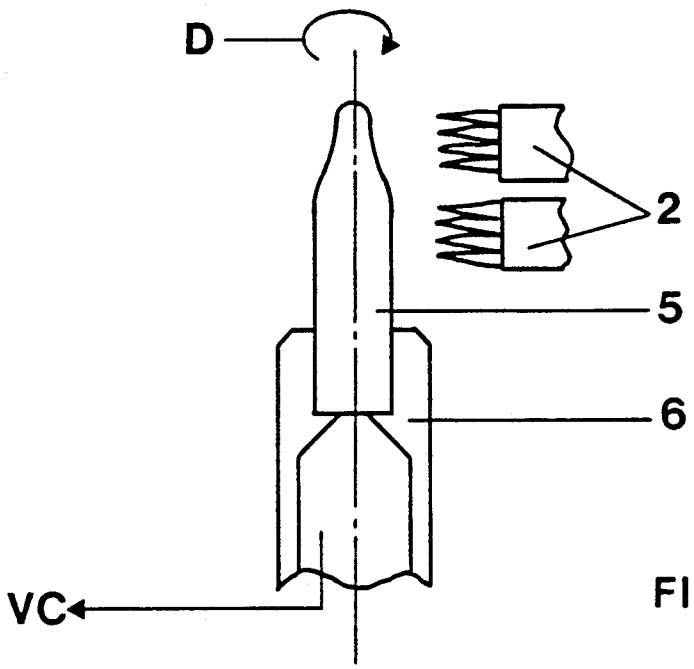
Figure 2E:
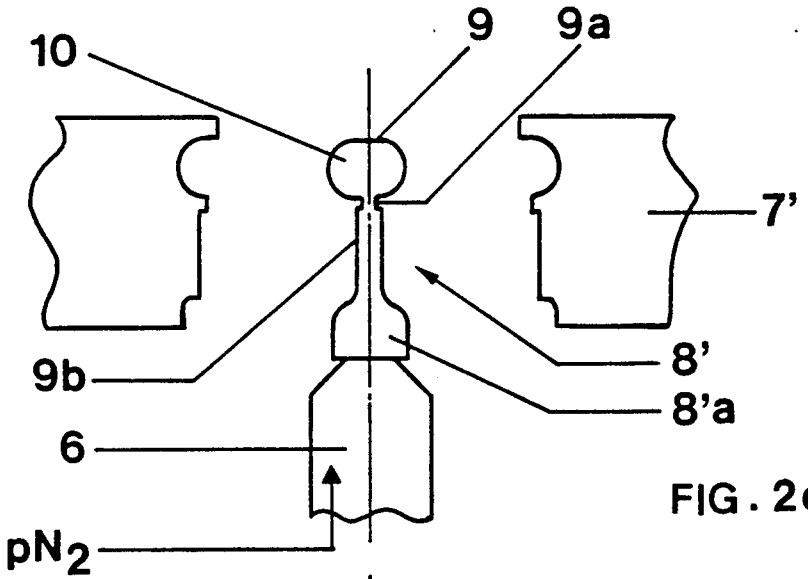
Figure 2F:
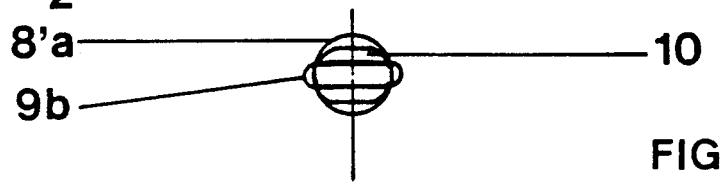

An alternative possibility is shown in FIGS. 2*d* to 2*f*. A relatively large part of the tube element 5 is heated by flames 2. When the quartz glass is soft, the flames 2 are stopped and two forming jaws 7' having a skirt or enlarged base are moved to surround the large part of element 5 under $N_2$ pressure. The blow-molding of the tube element 5 results in a raw tube 8' which forms a light emitting vessel 10 having, for example, an ellipsoidal shape, a bottle-necked portion 9*a* and a squeezed region 9*b*, preshaped for pinch-sealing so as to have, for example, an oval cross section and a circular collar 8*a'*.

The raw tube or lamp blank 8 could also be made by using a quartz glass tube which is open at both ends, then using the form roller 4 (FIG. 1*c*) and then blow-molding in the blow-molding jaws 7 to form the subsequent light emitting vessel 10 with the dome 9.

Referring next to FIGS. 3*a* to 3*d*:

A holder die 11 is then placed into the blank 8. The holder die 11, which is adapted for retaining pairs of electrode systems, to work with a substantial number of blanks, alternately, retains a pair of electrode systems formed by the electrodes 14, foils 13 and connecting leads 12. Preferably, the holder die holds the electrode leads 12. The holder die 11 has spring elements 11*a* at the circumference, of which only one is shown. These spring elements preferably three engage at the inner wall of the blank 8 and provide for self-holding of the die 11 within the inner wall while, at the same time, ensuring centering. A predetermined position of the electrodes 14 within the light emitting vessel 10 is ensured by introducing the electrode systems 12, 13, 14 into the lamp only up to a certain stop or abutment point. The arrangement of placing the electrodes is shown schematically only in FIG. 3*a*, for clarity of illustration. The position of the electrodes is predetermined, for example, by a rod 11*b* connected to the holder die 11 via an arm 11*c* located outside of the raw tube to determine the plane of the dome-shaped end portion 9.

Figure 3A:
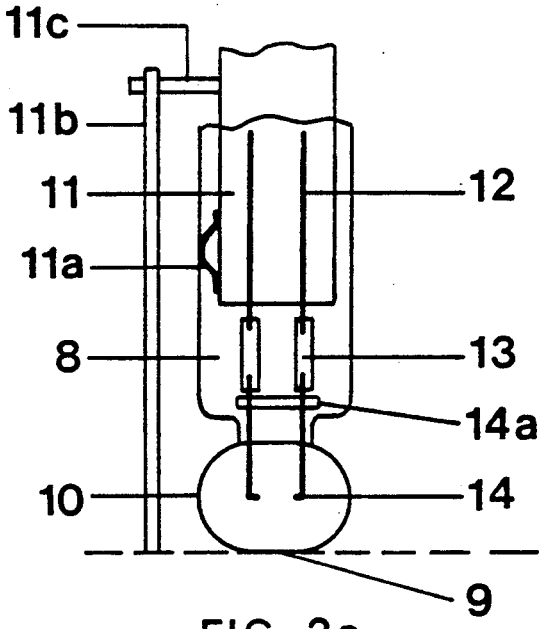

This step is well known in the lamp manufacturing art and, therefore, is shown only schematically. The precise spacing of the electrodes 14 with respect to each other additionally can be ensured by a spacing holder 14*a*, formed for example of a quartz glass strip or similar material. This spacing holder extends between the two electrodes outside of the die, as shown in FIG. 3*a* for example. Upon subsequent pinch-sealing of the lamp, the strip 14*a* is heated together with the remainder of the lamp, and incorporated in the pinch seal and remains within the pinch seal.

Figure 3B:
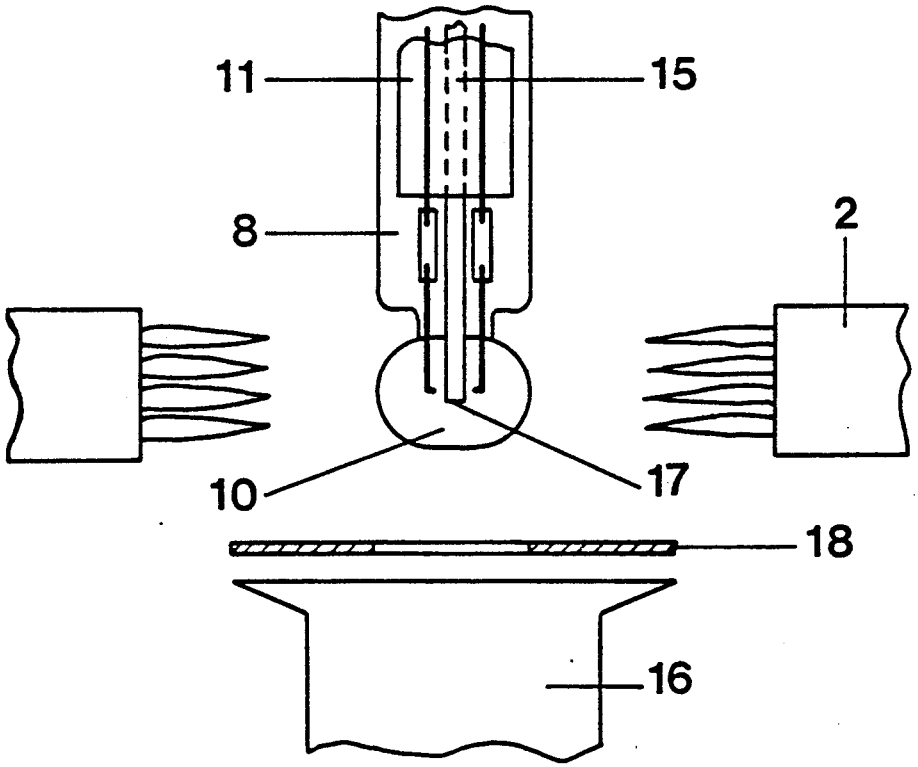
Figure 3C:
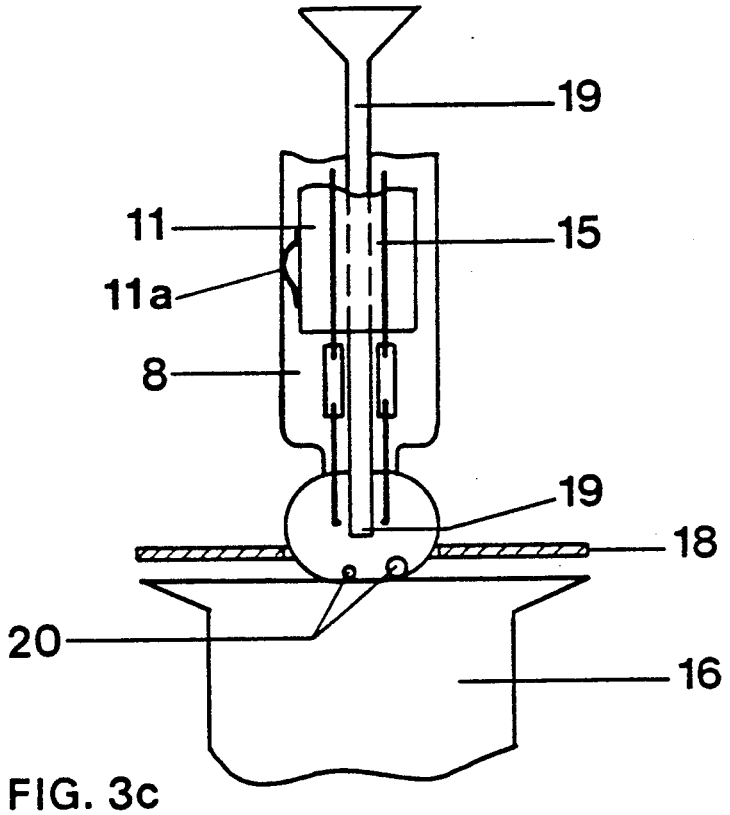

The holder die 11 is provided with an axial bore 15 (only shown in FIGS. 3*b* and 3*c*). In the pinch sealing and manufacturing machine 16, a small auxiliary tube 17 is introduced through the opening 15 into the light emitting vessel 10. Preferably, the tube 17 is introduced centrally within the vessel 10, and may extend beyond the electrodes, as shown in FIG. 3*b*. The tube, and specifically the vessel 10, is heated by flames 2 to about 1000° C. An inert gas stream is introduced for about 6 seconds; the quantity of gas flow may vary from about 50 l/h to about 500 l/h, in dependence on the volume of the vessel. The inert gas can be a noble gas suitable also for the gas fill; it can be argon or nitrogen, or another suitable flushing gas. The flushing gas removes contaminants from within the lamp vessel 10.

The lamp 10 is then cooled by compressed air until the bulb temperature will be about 60° C. to prepare the next manufacturing step.

The blank 8, now having the electrode system 12, 13, 14 inserted therein, flushed, and cleaned by heating to glow temperature while introducing flushing gas, is then, still on the operating station 16, moved down to a ring-shaped diaphragm 18; the flames are removed, for example by being rotated laterally away from the lamp, and the bulbous end is fitted against the diaphragm 18, see FIG. 3*c*. The tube 17 is withdrawn and a funnel-tube combination 19 is introduced through the opening 15 in the holder die 11. The required fill material 20 is introduced through the funnel 19. The fill substances 20, in case of a metal halide high-pressure discharge lamp, will be, for example, a pill of metal iodides and a mercury drop. The quantity and type of fill material will depend on the use and eventual fill of the lamp; some lamps do not require mercury.

Figure 3D:
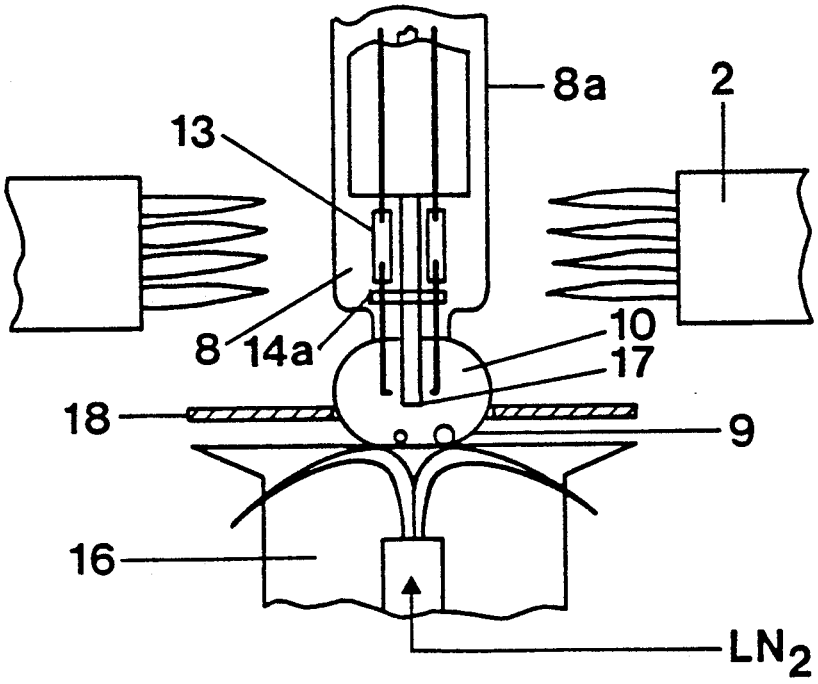

The fill funnel 19 is then removed and the tube 17 again introduced into the lamp, see FIG. 3*d*. The flames are again projected against the lamp blank 8, now, however, directed against the region where the molybdenum foils 13 are located. The flames heat the lamp in the region of the molybdenum foils to about 2200° C. The advantage of this technology is that the flames cannot contaminate the already cleaned foils because the foils are protected by the long collar 8*a* of the raw tube 8. At the same time, the subsequent noble gas atmosphere, forming another fill substance, is maintained through the tube 17. The lower part of the light emitting vessel 10 is cooled from below by liquid nitrogen, as schematically shown by the arrow $LN_2$. The ring diaphragm 18, which surrounds the lamp vessel 10 from below, separates the region to be heated, that is, close to the sealing foils 13, from the end of the lamp being cooled.

Figure 4:
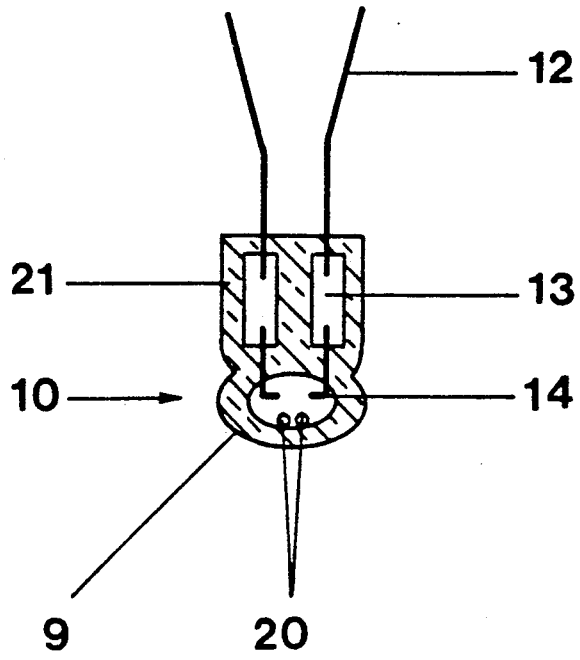

When the required temperature is reached in the region of the sealing foils, the tube 17 is withdrawn and the blank 8 is sealed by pinch jaws moving perpendicularly to the plane of the drawing to form a press seal 21 (see FIG. 4) and the projecting part of the collar, which has not been pinched, may be cut off.

After sealing by the press seal 21, the fill substances 20 since cooling by flushing and introduction of fill gas is now lacking, will vaporize at least in part due to the electrodes 14 which will have become hot and glowing. The at least partial vaporization of the fill substances 20 causes an increase of the pressure within the lamp vessel 10.

To prevent deformation of the lamp vessel 10 (see FIG. 4) by subsequent expansion or inflation, the pinch jaws may have shaping or mold additions placed thereon, corresponding to the final or subsequent form of the lamp vessel 10. These pinch jaws are not shown in FIG. 3*a*, but may be similar, for example, to the jaws 7', see FIG. 2*b*.

The lamp vessel 10 can be used directly as a metal halide high-pressure discharge lamp. It need not have an outer bulb around it.

Rather than using an electrode system in which two spaced electrodes 14 are introduced into the bulbous light emitting vessel 9 for an arc discharge therebetween, a filamentary type electrode system can be used.

Figure 4A:
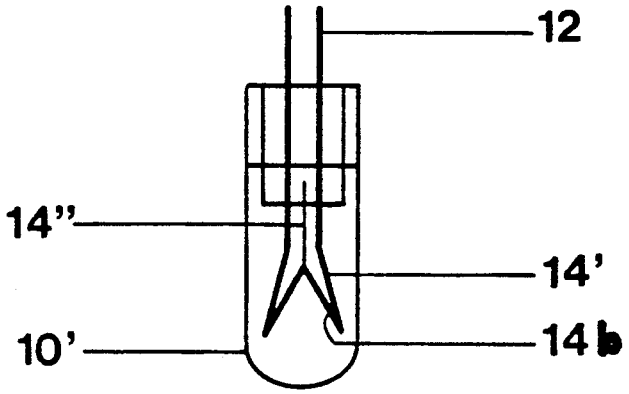

FIG. 4*a* shows a halogen incandescent lamp vessel with an electrode system having the current supply leads 12 and two electrode stems 14' between which a schematically shown filament 14*b* is located, supported by a third stem 14'' anchored in the pinch seal. The vessel is made from hard glass, and sealing foils can therefore be omitted. The production steps are identical except that the step of introducing fill substances, discussed above in connection with FIG. 3*c*, has to be matched to the specific requirements of the halogen incandescent lamp and introduction of special solid substances through a funnel may not be required. Since the filament may take up somewhat more space than the discharge between two electrodes 14', the light emitting vessel or, lamp bulb 10', can be longer with a hemispherical or half-ellipsoid end cap.

Some lamps, and particularly discharge lamps, use argon as the noble gas fill (see FIG. 3*d*). In some other lamps, an expensive noble gas is used, such as xenon, or a fill gas which may have radio-active additives therein. In this case, the flushing step (FIG. 3*b*) is preferably carried out with an inexpensive inert gas; likewise, the flushing just in advance of the pinching step (FIG. 3*d*) is also done with an inexpensive inert gas; the final desired fill gas is introduced in the last moment just before the pinch jaws pinch the glass bulb and upon withdrawal of the tube 17. In other words, a change-over of the gas supply through the tube 17 is done immediately in advance of the pinching step.

The end portion or collar of the glass tube, projecting beyond the pinch seal, may be cut off beyond the pinch seal at a suitable time, for example as soon as the lamp has cooled sufficiently to permit easy handling. With some lamps, however, it is desirable not to cut off this collar.

The method of filling the fill gas can be used successfully for cold fill pressures up to about 1000 mbar. If fill pressures above 1000 mbar are desired, it is necessary to freeze the required quantity of the desired fill gas within the lamp vessel 10. This can be carried out by spraying, for example, a supercooled liquid gas against the outside of the bulb, or immersing a portion of the outside of the bulb in a supercooled liquid gas, for example liquid nitrogen. Whether spraying or dipping is done will depend on the eventual fill pressure. Such processes are known and any suitable arrangement can be used to carry them out. Due to the very short time to heat the glass to pinching temperature, even substantial temperature differences can be tolerated.

Figure 5A:
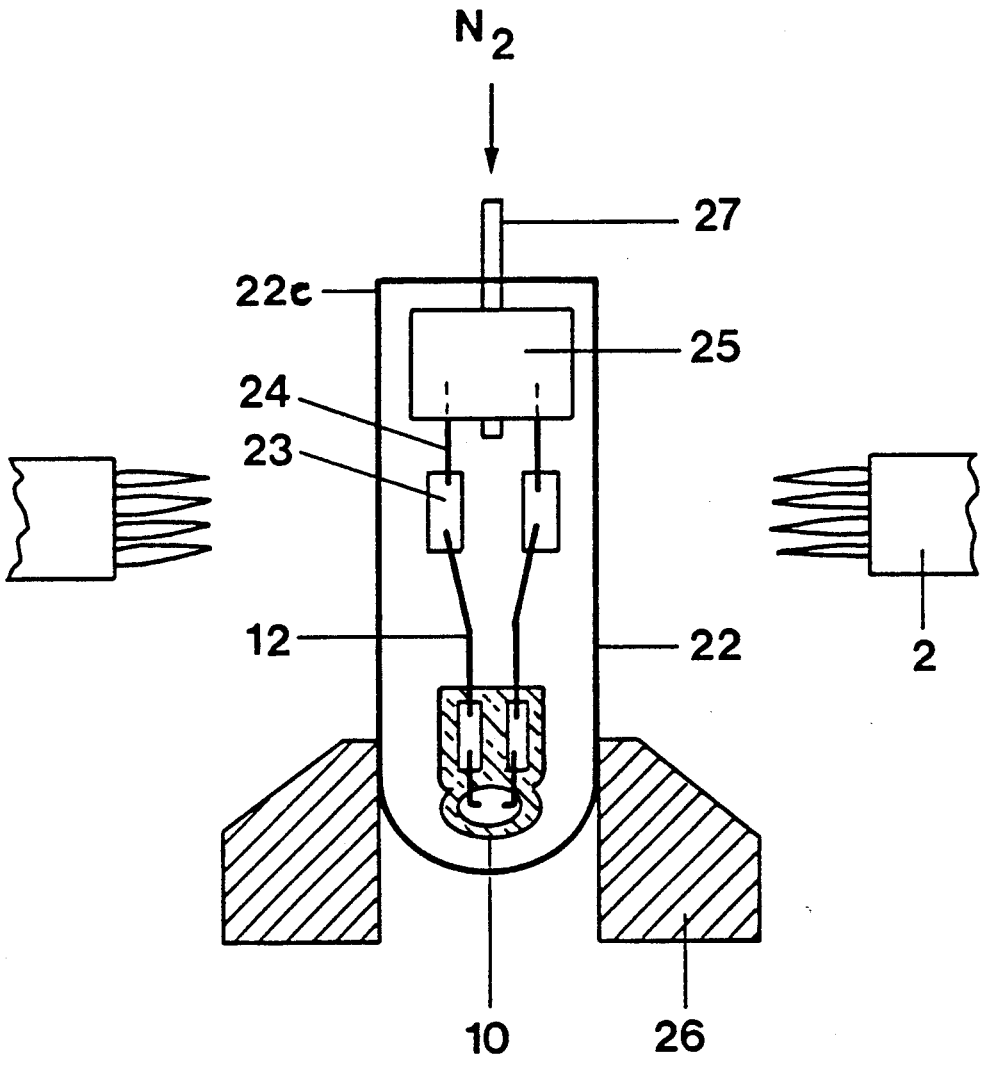
Figure 5B:
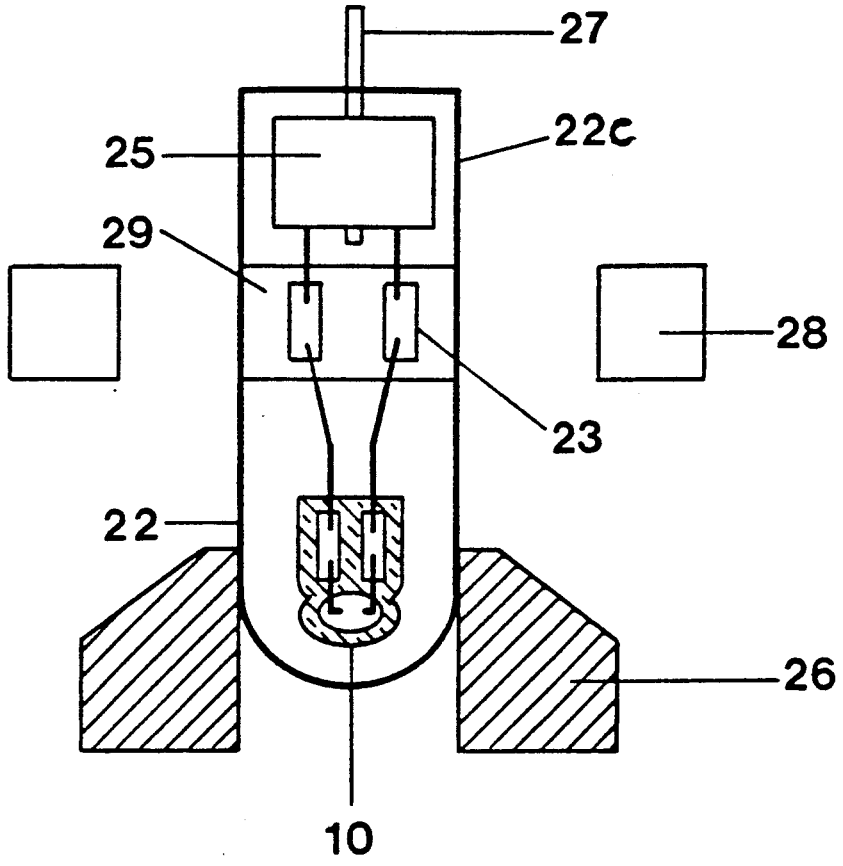
Figure 5C:
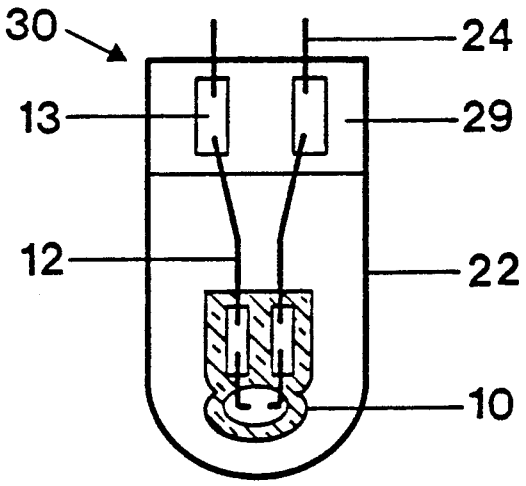

Some lamps, and specifically metal halide discharge lamps, are desirably enclosed within an outer bulb or outer housing or cover. Referring now to FIGS. 5*a* to 5*c*: The finished lamp 10 or 10' (FIGS. 4, 4*a*) is introduced into an outer bulb 22 of quartz glass. The outer bulb 22 can be made from quartz glass or hard glass in accordance with any well known manufacturing process and, for example, identical to the process described in connection with FIGS. 1*a* to 2*b*, resp. 2*e*; the only difference will be in the shape of the blow molding jaws 7.

The externally extending electrode leads 12 of the lamp 10 are connected to a further set of molybdenum foils 23, from which projecting leads 24 extend. The projecting leads 24 as well as the leads 12 can be connected to the molybdenum foils 23, as well known, for example by welding. The effect, thus, is to make the electrode connections longer. A holding die 25 is provided to hold the lamp 10, foils 23 and projecting leads 24 in position. The holding die 25, except for its size and the size of the holding elements thereof, can be identical to the holder die 11. The die 25, with the lamp 10 and foils 23 and leads 24 thereon, is introduced into the open end of the outer bulb 22 up to a predetermined location, for example by a system similar to that described in connection with FIG. 3*a*. The outer bulb 22 is filled with inert gas in a way similar to that previously described, for example by introducing nitrogen through an opening in the die holder 25, as schematically shown in FIG. 5*a*.

After the lamp 10 is introduced into the outer bulb 22 in its predetermined position, flames 2 are directed to the bulb 22 in the region of the position of the foils 23. Simultaneously, nitrogen for example is introduced through the flushing tube 27; other gases may be used.

When the glass of the outer bulb 22 is sufficiently heated to permit its deformation, four pinching jaws are moved thereagainst, two jaws (not shown) in a direction transverse to the plane of the drawing, that is, perpendicularly to the major surface or plane of the foils 23 and two auxiliary jaws 28 moving in the plane of the foils 23. The pinching jaws can also cause a slight overall indentation ahead of the press seal, as shown at 22*a* in FIG. 10. When the press is made, see FIG. 5*b*, the pinch or press seal 29 will be formed, and the remaining glass tube 22*c* cut off to size. It is equally possible to use only two pinching jaws.

As seen in FIG. 5*c*, a metal halide discharge lamp 30, within an outer cover 22, is provided which has no pump or exhaust tip either on the smaller inner metal halide discharge lamp 10 nor at the outer cover 22.

The flushing tube 27 is pulled outwardly from the lamp vessel 30, the lamp vessel 30 taken from the holder 26 in which it was previously retained (see FIG. 5*a*). The holding die 25 is removed from the lamp vessel 30 and any excess glass tubing is cut off.

Figure 10:
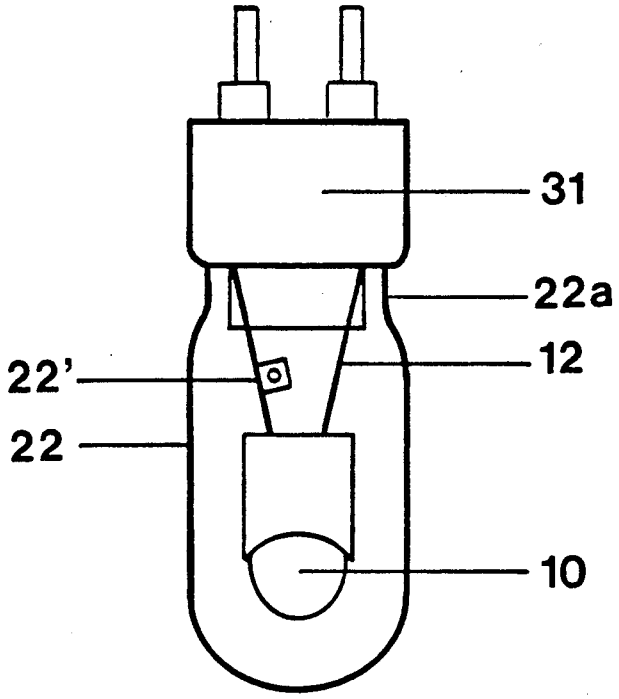
FIG. 10 shows a single-ended metal halide discharge lamp within an outer bulb.
Figure 11:
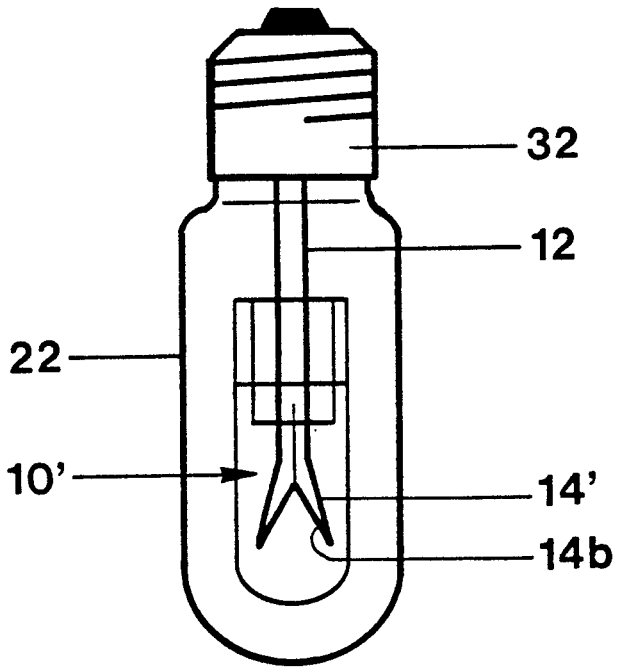
FIG. 11 shows a halogen incandescent lamp within an outer bulb.

The resulting lamp 30, which is fitted with a metal halide discharge lamp 10 with a metal halide fill 20, then has a base 31 applied thereto, for example of the type G12, see FIG. 10. If the inner light emitting element is an incandescent filament, so that the lamp is a halogen incandescent lamp 10', as seen in FIG. 11, a base, for example of the type E27 is fitted to the outer cover 22. The press seal 29 is visible only partially in FIGS. 10 and 11 since part of it is hidden by the base.

In accordance with a feature of the invention, the pinch or press seal which seals the electrodes can be so made that the requirement for withdrawing the tube 17 from the die holder just prior to forming the pinch or press seal can be avoided by forming the pinch or press seal in such a manner that it only pinches and seals the electrode leads (and respectively the molybdenum foils), while leaving capillary openings for gas exchange with the interior of the bulb.

Figure 6A:
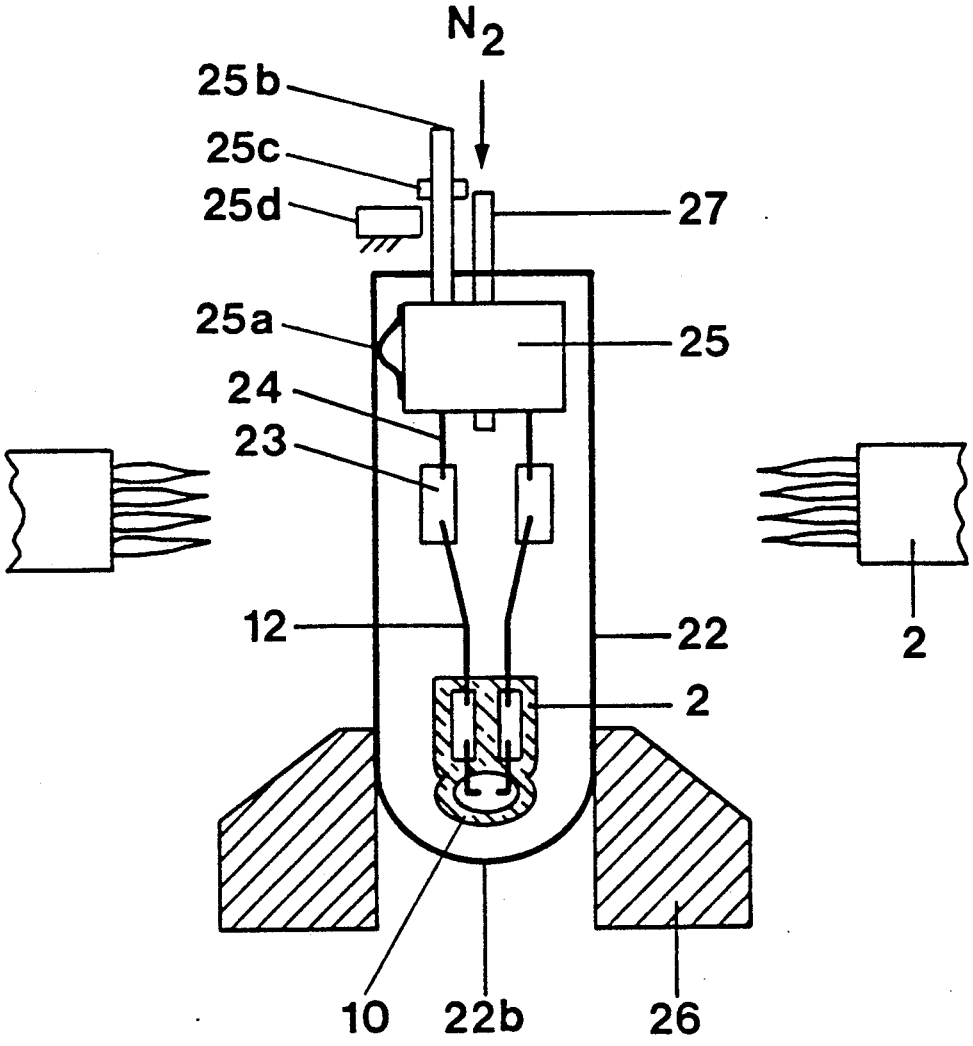

FIG. 6*a* illustrates formation of such a dual-step seal with reference to the outer bulb 22.

The bulb 22, which has a rounded end 22*b*, of quartz glass has the discharge lamp 10 therein; of course, rather than having the discharge lamp 10, it could have a halogen incandescent lamp 10' or filaments directly connected to the filament leads 12. The filament leads 12, connected through foils 23, are externally electrically accessible through the projecting leads 24. The external leads 24 are clamped in the holding die 25.

Holding die 25 has resilient elements 25*a*, only one of which is shown, at the circumference thereof, which engage against the inner wall of the quartz tube which forms the bulb 22. The predetermined position of the discharge vessel, or filament or other electrical system within the bulb 22 is obtained, for example, by introducing the holder die 25 into the open tube until a collar 25*c* on a holder rod 25*b* engages an abutment 25*d*. The bulb 22 is held in position by a holder 26. The illustration is schematic, since these steps are well known in lamp manufacture.

Flames 2 heat the tube forming the bulb 22 in the region of the sealing foils 23. The holder 25 is formed with an opening through which a flushing tube 27 is introduced, in order to permit introduction of nitrogen into the bulb, as schematically shown by arrow $N_2$. For a bulb, a flushing step of about 10 second duration, with a quantity of between 50 1/h to about 500 1/h is suitable, the quantity depending on the volume of the bulb. The flushing with nitrogen is intended to remove contaminants within the bulb 2.

Figure 6B:
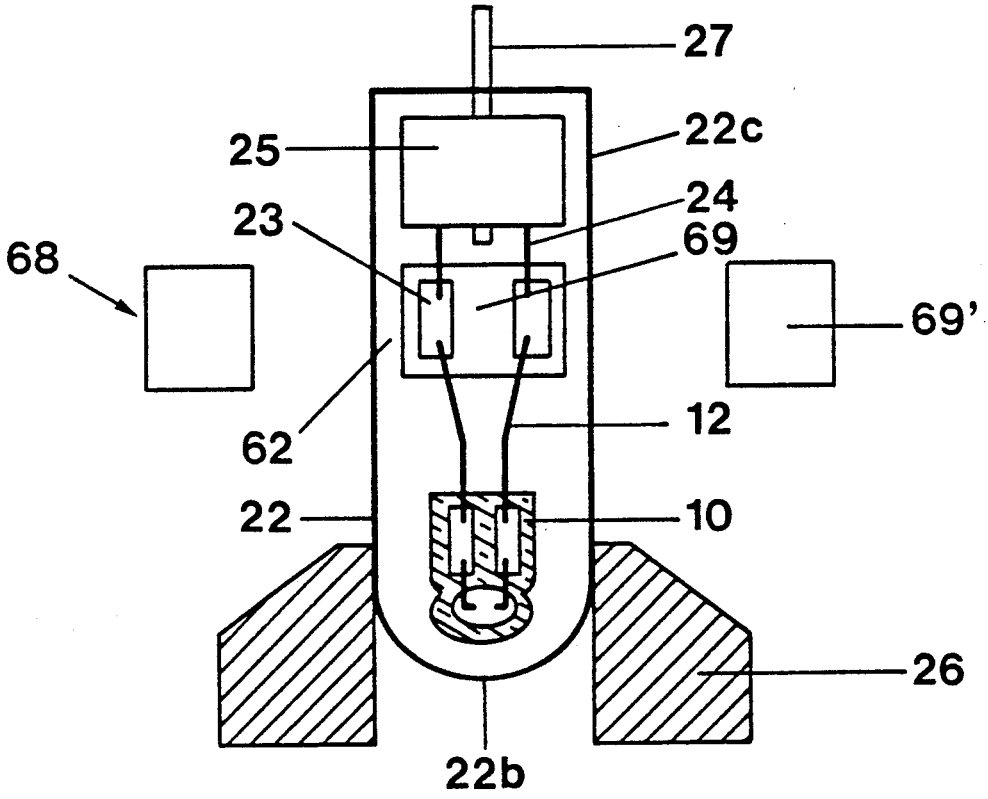

As soon as the region of the sealing foils 23 has the requisite temperature for deformation thereof, for quartz glass about 2200° C., a pinching step is carried out in that pinching jaws 68 (see FIGS. 6*b*, 6*c*) are moved towards each other. FIG. 6*b* shows in detail only parts of the jaws, namely the small laterally moving auxiliary jaws 69' which press the lateral glass portion against the acute sides of the foils 23.

In accordance with a feature of the invention, and as best seen with reference to FIGS. 7*b* and 7*c*, the jaws 68, 69' have a specific shape and pinch the electrode system 12, 23, 24 in position, but leave capillary openings 62 adjacent the sealing region.

The specific form of the sealing jaws 68, and their effect upon sealing is shown in FIGS. 7*a* to 7*c*. The sealing jaws 68 have a pair of oppositely located main pinching jaws 68' and a pair of oppositely located lateral auxiliary jaws 69'. The arrows in FIG. 7*a* illustrate the movement of the respective jaws during the pinch sealing step. At respectively opposite active pinching surfaces of the main pinching jaws, they have a shape which has first a portion which, upon pinching, will be essentially parallel to the major plane of the sealing foils 23, as shown at portions 68*a*. Customarily used main jaws have a steplike recess in the outer sixth of the distance from the center. In contrast, now at roughly the outer third of the distance from the center of the jaws 68', the jaws open with strongly inclined surfaces 63 (inclination angle about 60°) to a lateral recess 64. In contrast to the customarily used lateral auxiliary jaws/-having a nose in the middle of their active pinching surface, the auxiliary jaws 69' have a flat surface 65 which, when they close against the main jaws, during the pinching step—see FIG. 7*b*—prevent lateral escape of quartz glass from the pinch seal 69. This will leave, within the pinch seal 69, two channel-like voids or capillary spaces 62, see FIG. 7*b* and the cross section of the resulting pinch seal in FIG. 7*c*. These capillary openings can replace the previously customary pumping tube through which the bulb 22 can be evacuated and/or filled.

For forming the pinch or press seal, the bulb is placed in position between the pinching jaws 68', and the pinching jaws 68' as well as 69' are then moved in the direction of the arrows, see FIG. 7*a*. Upon movement of the jaws 68', 69' towards each other, as seen in FIG. 7*b*, the seal seen in FIG. 7*c* will result.

Figure 8:
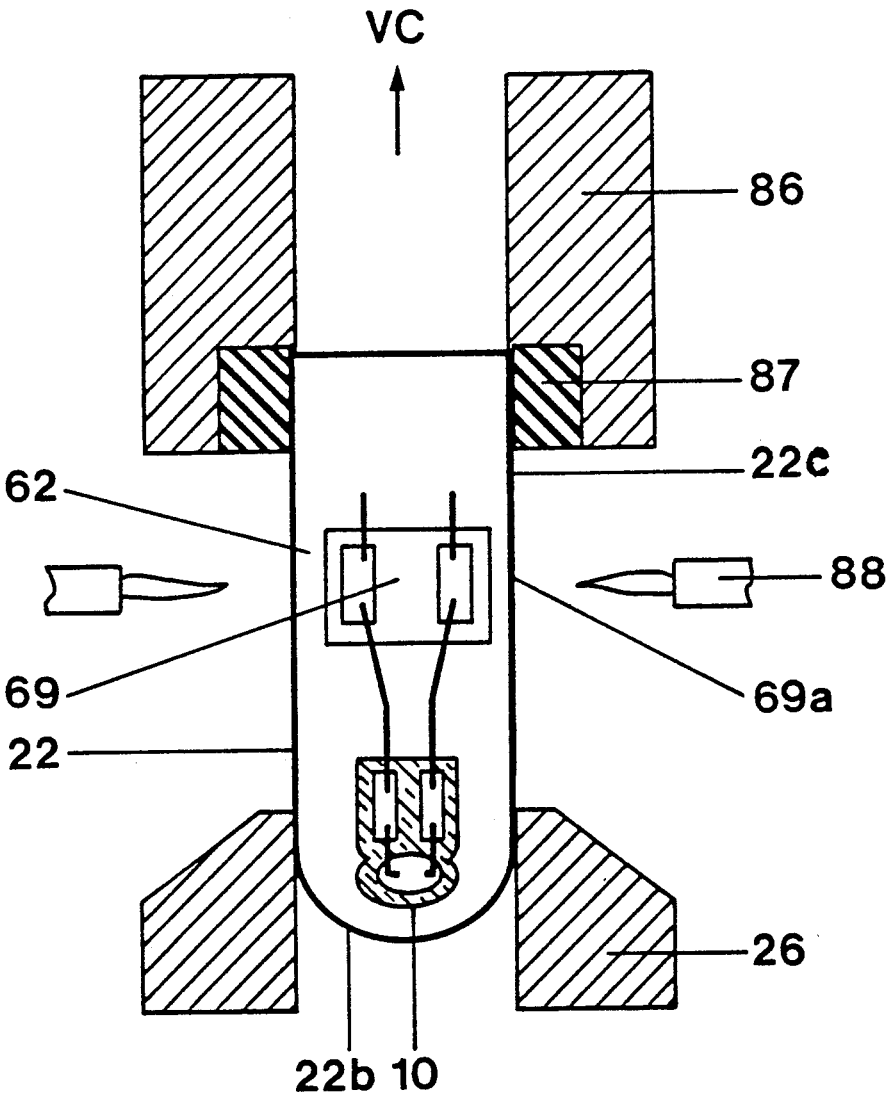
FIG. 8 shows the lamp after the electrode system has been pinch-sealed, in a pumping machine.

The bulb, formed with the seal of the electrodes therein and the capillaries 62, will also have lateral glass portions 69*a*. The bulb 22 then is clamped in a pumping head 86, see FIG. 8. The pumping head 86 has a sealing ring 87 made from rubber which surrounds the open end 22*c* of the tube forming the bulb 22. Pumping head 86 is in communication with the interior of the bulb 22 through the capillaries 62. The sealing ring 87 is used to seal the system during pumping.

Figure 9:
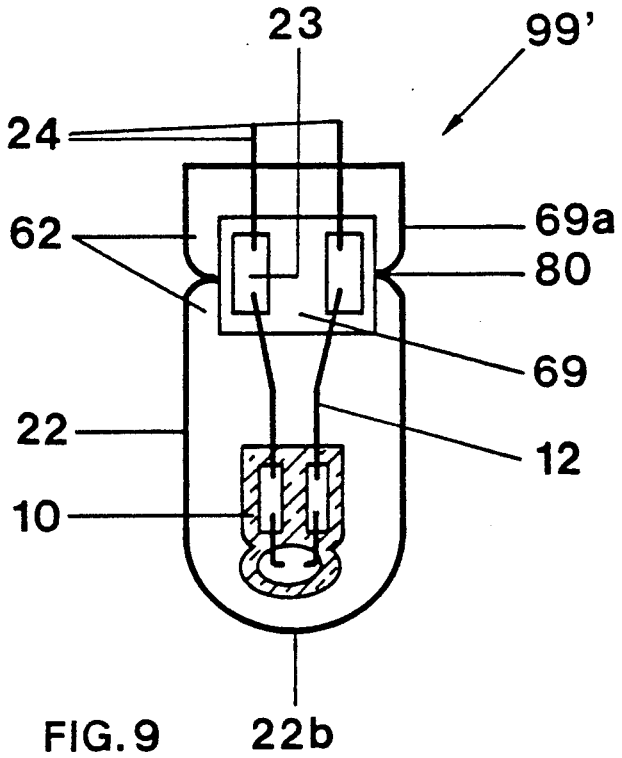
FIG. 9 shows the lamp bulb finished sealed.

The pumping head 86 is coupled to a vacuum pump schematically shown at VC, through which the bulb 22 can be evacuated through the capillaries 62. Thereafter, a point flame 88 is applied to the bulb 22 from the outside in the region of the lateral glass sides 69*a* and the still open capillaries 62 are melted shut. The finished lamp vessel 99', as seen in FIG. 9, is evacuated and sealed with respect to outside space. The pinch sealing region only has the pinch seal 69 and the capillary melt-off regions 80. There is no exhaust tube or tip from either the inner bulb 10 or the outer bulb 22, or from the base region thereof.

The portion 22*c* of the glass tubing, extending beyond the region of the pinch seal is cut off at a suitable position after removal of the pumping head 86.

The resulting lamp 99', in the specific example described, retains a metal halide high-pressure discharge lamp 10 therein. A getter 22' can be placed inside the bulb 2 fixed on one of the electrode leads, or otherwise secured in the pinch or press seal 69. The getter can accept any possible remaining contaminants within the outer bulb 22. If the inner lamp is a halogen incandescent lamp, a screw base 32 is used.

In accordance with this feature of the invention, the pinch or press seal method is carried out in two steps. First, the pinch seal is effected with respect to the electrical conductors, to form a tight seal of the electrical conductors to the bulb material; and then, in a second step, by means of the point flame 88, see FIG. 8, the bulb is sealed off, by closing the capillaries 62, that is, by melting shut the capillaries as seen at 80 in FIG. 9, to thereby form a completed pinch or press seal lamp bulb with the electrode seals in the region of the foils.

The evacuating function of a pumping tube (FIG. 8) therefore can be taken up by the capillaries 62 which, after forming the pinch seal for the electrodes, will result when a form of pinch jaws 68 is used which leaves voids or capillaries adjacent the seal for the electrodes. These capillaries are easiest made by specially shaping main and auxiliary lateral pinch jaws. This system has the advantage that the actual sealing of the bulb, that is, the final closing of the capillaries by the flame 80, can be made by a point-shaped flame, directed at the center of the lateral surfaces of the pinch seal. The heat loading on the sealing ring 87 of the pumping head thus is low, making this process less expensive and more reliable.

The process is eminently suitable for mechanical, automated manufacture. It can be used to make single-ended pinch-sealed bulbs to retain light sources, as desired.

Various changes and modifications may be made, and features described in connection with any one of the embodiments may be used with any of the others, within the scope of the inventive concept.

As an illustration for a suitable use of the method, the discharge lamp 10 may have a rating in the range of:

power: 20 W to 150 W voltage: 50 V to 250 V volume of discharge vessel 10: 0.01 $cm^3$ to 1.5 $cm^3$ described, for example, in U.S. Pat. No. 4,717,852

If a halogen incandescent lamp (FIG. 11) is used, the lamp 10' may have the following ratings and characteristics:

power: 2 W to 150 W voltage: 1.5 V to 250 V diameter of light emitting vessel 9': 4 mm to 35 mm volume of vessel 9': 0.05 $cm^3$ to 30 $cm^3$ The method described in connection with FIGS. 6*a* to 8 is particularly applicable for bulbs or light generating or emitting structures, in which the diameter of the lamp is somewhat greater than that for miniature metal halid high-pressure discharge lamps, for example for any kind of lamp, and especially for lamps requiring a halogen fill and having a press seal, in which the diameter of the bulb 22 is upwardly of about 6 mm, with a bulb volume in the range of about 5 $cm^3$.

The foregoing dimensions are not critical and limits of the applicability may depend, for example, on economic factors.

Figure 12:
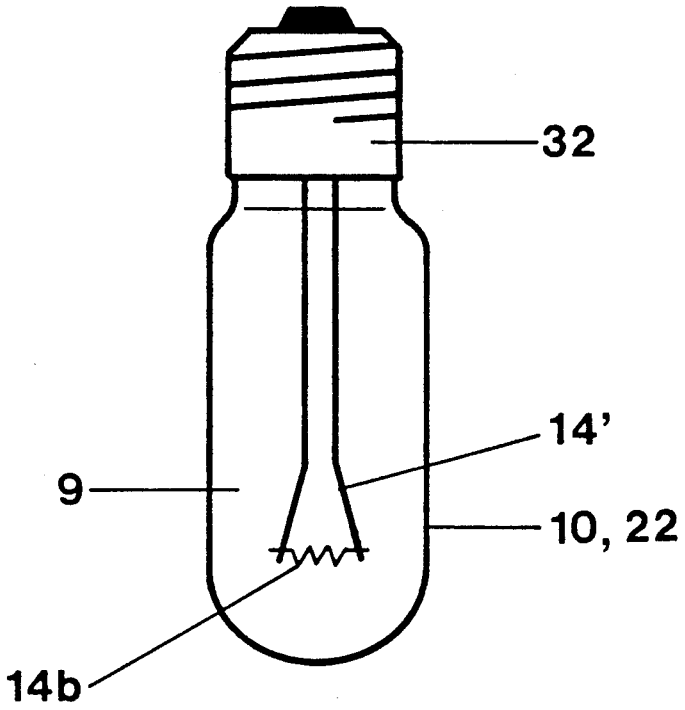
FIG. 12 shows a halogen incandescent lamp with a screw base.

FIG. 12 illustrates a bulb as described in detail in connection with FIGS. 6*a* to 9, with the difference, however, that the electrode structure 12, 23, 24 does not carry another, inner or internal bulb which, in turn, carries the light emitting structure but, rather, the electrodes 14' are directly connected to a filament, schematically shown at **14*b***. In the case of such a lamp, or in the case of filling an outer bulb with an inert gas, the capillaries are not only used for evacuating the bulb but also for filling it with fill gas, for example an inert gas and/or gaseous halogen compounds.

We claim:

1. Method of making a lamp having a bulb (10, 22);

an electrode system located in the bulb, said electrode system including electrodes (**14, 14*b***) located in the bulb;

current supply leads (12, 24) connected to the electrodes and extending externally of the bulb; and a single pinch or press seal (21, 29) sealing said electrode system gas tightly into the bulb and defining a light emitting vessel (9, 9', 22) therein, said method comprising, in accordance with the invention, the following sequential steps:

heating a glass tube (1) and closing off the tube by a forming means (4) to form a glass tube (5) closed at one end;

blow-molding the closed glass tube (5) to form the shape of said light emitting vessel (9) of the bulb (10) and to provide a raw bulb or blank (8);

retaining, in a holder die (11, 25) said electrode system (12, 13, 14; 12, 23, 24), introducing said electrode system into the light emitting vessel in the raw bulb or blank, and placing said system in the bulb while it is being held in the holder die;

flushing the bulb by introducing and removing flushing gas through the open end of the raw bulb or blank (8);

introducing a measured or dosed quantity of fill substances (20) into the raw bulb through the open end thereof; and heating the raw bulb and pinch-sealing the electrode system into the raw bulb.

2. The method of claim 1, including the step of severing glass material projecting from said bulb seal (21) remote from the light emitting vessel (9) to form the entire bulb after the pinch-sealing of the electrode system.

3. The method of claim 1, wherein the step of closing off the tube by the forming means (4) comprises rolling the heated, softened glass tube until opposite walls join.

4. The method of claim 1, wherein the step of heating and closing off said glass tube comprises heating a glass tube (1) open at both ends in a central region thereof;

and applying a symmetrical form roller against said central region, and rotating said tube and said form roller to join oppositely positioned wall portions of said tube together for closing said tube and preforming a closure region or line.

5. The method of claim 4, wherein the form roller is forked so as to provide for a bottle-necked portion (99) near the closure region or bulb end.

6. The method of claim 1, wherein said step of blow-molding the closed tube (5) comprises heating the closed end of the tube (5), placing said heated closed end in molding jaws (7) and selectively introducing vacuum, or gaseous over-pressure into the heated vessel retained within the mold.

7. The method of claim 6, wherein said step of blow-molding the closed tube comprises placing said closed end in molding jaws for forming a light emitting vessel, said molding jaws having a long skirt to preshape a squeeze region with an oval cross-section in which the pinch seal will subsequently be made.

8. The method of claim 6, wherein the gas over-pressure comprises pressurized nitrogen gas.

9. The method of claim 1, wherein said holder die (11) has resilient elements (11', 25') at its outer circumference engageable with the inner wall of the raw tube or blank (8) to provide for at least one of: self-holding, self-centering, of the holder die in the tube of the blank.

10. The method of claim 1, wherein the step of positioning said electrode system in a bulb comprises placing said bulb in a predetermined position;

and introducing said die holder up to a predetermined stop or abutment element (**11*d*, 25*d***).

11. The method of claim 1, further including a spacer element (**14*a*) of glass compatible with the glass of said bulb and holding said electrodes in relatively fixed position, said spacer element (14*a***) being positioned on said electrodes in a region where it will be pinched and form part of said pinch or press seal upon carrying out said pinch sealing step.

12. The method of claim 1, wherein the holder die includes an opening or through-bore (15);

and wherein said step of flushing the bulb comprises introducing a flushing gas tube (17) through said opening up to and into said light emitting vessel (9).

13. The method of claim 1, wherein the step of introducing and removing flushing gas through the bulb comprises introducing, for between about 6–10 seconds, a gas stream of inert gas at a rate of between about 50 l/h to about 500 l/h, and further including the step of heating at least said light emitting vessel (9) to a temperature of at least 1000° C., while carrying out said introduction of inert gas.

14. The method of claim 1, wherein said holder die includes an opening or bore (15);

and wherein said step of introducing fill substances into the bulb or blank (8) comprises placing a filling funnel (19) through said bore in said die holder and introducing said fill substances through said filling funnel.

15. The method of claim 1, wherein said step of forming said pinch or press seal comprises heating a region of the raw bulb or blank at the location of the pinch seal while simultaneously cooling a region of the light emitting vessel (9) remote from said sealing foils, and flowing a noble gas into said light emitting vessel.

16. The method of claim 15, including the step of separating the region of the pinch seal and the region of the light emitting vessel remote therefrom and being cooled, by a ring diaphragm (18);

and wherein said cooling step of said region of the light emitting vessel comprises applying liquid nitrogen ($LN_2$) thereto.

17. The method of claim 1, wherein the holder die includes a bore or opening (15) formed therein;

a gas conduction duct (17) located in said bore and extending at least up to said light emitting vessel (9);

and wherein the step of pinch-sealing the electrode system into the raw bulb includes the step of withdrawing said tube (17) from the raw bulb or blank (8) as the pinch or press seal is being made.

18. The method of claim 1, including the step of cooling the pinch seal by compressed air subsequent to the formation of the pinch or press seal.

19. The method of claim 1, wherein said step of pinch-sealing the electrode system into the raw bulb comprises pinching the tube in the region of the electrode system to form a pinch or press and gas-tight seal to said electrode system in the material of the tube, while leaving capillary communicating openings (62) within the pinch or press seal between the outer wall (69*a*) of the tube and the pinch or press seal (69) surrounding, and sealing and gas-tightly encapsulating said electrode system;

and further including the steps of effecting gas exchange between the interior of said light emitting vessel (9) and the outside thereof through said capillary openings;

and then melt-sealing the capillaries (62).

20. The method of claim 19, wherein said step of forming the pinch or press seal comprises forming a pinch seal across said tube in a central region thereof to leave said communicating capillary openings (62) just inwardly of the outer wall (69*a*) of the bulb.

21. The method of claim 19, wherein said step of forming said pinch or press seal, while leaving said communicating capillary openings (62) comprises pinching the heated softened tube in the region opposite said electrode system by main pinching jaws (68') which have a pinch or press surface (68*a*) extending essentially parallel to said sealing foils, starting from a center line thereof, up to about the outer third of the jaws; then having an outwardly inclined surface (63) and terminating in an outer recessed surface (64) which is parallel to said sealing foils;

and introducing auxiliary lateral sealing jaws (69') towards said main jaws, said lateral auxiliary sealing jaws laterally closing off said recessed surfaces (64) of the main jaws.

22. The method of claim 19, wherein the step of sealing off said capillary communicating openings (62) comprises applying a point form heat source (88) essentially centrally with respect to said pinch or press seal against the outer wall regions (69') of the tube and where the capillaries were formed, to melt together said capillaries and seal the openings formed thereby.

23. The method of claim 1, wherein said glass tube comprises quartz glass and wherein the electrode system includes sealing foils, connecting the current supply leads to the electrodes; and wherein the sealing foils mark the region in which the pinch seal will subsequently be made.

24. The method of claim 23, further including the step of introducing the complete bulb (10,10') into an outer bulb (22) and filling said outer bulb with a gas or evacuating said outer bulb.

25. The method of claim 24, wherein said outer bulb is made in accordance with the method defined by claim 1.

26. The method of claim 24, wherein said outer bulb is made in accordance with the method defined by claim 5.

27. The method of claim 24, wherein said outer bulb is made in accordance with the method defined by claim 6.

28. The method of claim 24, further including the steps of attaching a further set of sealing foils (23) to the current supply leads extending externally of the bulb (10, 10') being introduced into said outer bulb, and extending further current supply leads (24) from said further foils (23);

retaining said further current supply leads (24) in a further holder die (25), and introducing said further holder die into said outer bulb (22) up to a predetermined position to place the inner bulb (10) in a predetermined location within the outer bulb (22).

29. The method of claim 28, further including the steps of introducing a stream of noble gas into said outer bulb for cleaning and flushing said outer bulb and optionally retaining said noble gas therein.

30. The method of claim 28, further including the step of heating said outer bulb in the region of the further foils (23) and forming a press seal around said further foils to seal the electrodes retaining the inner bulb within the outer bulb.

31. The method of claim 30, wherein said step of forming the pinch or press seal comprises forming a pinch seal across said tube in a central region thereof to leave said communicating capillary openings (62) just inwardly of the outer wall (69*a*) of the bulb.

32. The method of claim 29, including the step of severing an end portion of material forming said outer bulb extending by a predetermined dimension from said pinch or press seal.

33. The method of claim 24, further including the step of applying a base (31, 33) to the outer bulb (22).

* * * * *